US009413120B2

(12) United States Patent
Chen

(10) Patent No.: US 9,413,120 B2
(45) Date of Patent: Aug. 9, 2016

(54) CABLE CONNECTOR

(71) Applicant: BING XU PRECISION CO., LTD., New Taipei (TW)

(72) Inventor: Chih-jung Chen, New Taipei (TW)

(73) Assignee: BING XU PRECISION CO., LTD., New Taipei (TW)

( * ) Notice: Subject to any disclaimer, the term of this patent is extended or adjusted under 35 U.S.C. 154(b) by 0 days.

(21) Appl. No.: 14/645,881

(22) Filed: Mar. 12, 2015

(65) Prior Publication Data

US 2015/0270660 A1 Sep. 24, 2015

(30) Foreign Application Priority Data

Mar. 19, 2014 (TW) ..... 103204679

(51) Int. Cl.

| | |
|---|---|
| ***H01R 24/00*** | (2011.01) |
| ***H01R 24/62*** | (2011.01) |
| ***H01R 12/77*** | (2011.01) |
| ***H01R 12/79*** | (2011.01) |
| *H01R 107/00* | (2006.01) |

(52) U.S. Cl.

CPC ..... *H01R 24/62* (2013.01); *H01R 12/774* (2013.01); *H01R 12/778* (2013.01); *H01R 12/79* (2013.01); *H01R 2107/00* (2013.01)

(58) Field of Classification Search

CPC ..... H01R 24/62; H01R 12/79; H01R 12/774; H01R 12/778; H01R 212/675; H01R 12/592; H01R 13/6658; H01R 13/26; H01R 13/6469; H01R 13/6464

USPC ..... 439/676

See application file for complete search history.

(56) References Cited

U.S. PATENT DOCUMENTS 6,821,149 B2 * 11/2004 Lai ..... H01R 23/6873 439/607.31
6,866,538 B2 * 3/2005 Lee ..... H01R 12/675 439/404
7,261,582 B2 * 8/2007 Wu ..... H01R 13/6658 439/352
7,452,238 B1 * 11/2008 Wu ..... H01R 12/592 439/579
7,568,940 B2 * 8/2009 Cheng ..... H01R 23/10 439/489
8,641,452 B2 * 2/2014 Patel ..... H01R 13/6466 439/620.23
2005/0136747 A1 * 6/2005 Caveney ..... H05K 1/0228 439/676
2009/0163084 A1 * 6/2009 Straka ..... H01R 13/6658 439/676
2012/0034822 A1 * 2/2012 Bopp ..... H01R 13/6469 439/676
2012/0202389 A1 * 8/2012 Erickson ..... H01R 13/6464 439/676
2012/0309238 A1 * 12/2012 Huang ..... H01R 24/64 439/676
2014/0248807 A1 * 9/2014 Babu ..... H01R 13/26 439/676
2014/0256181 A1 * 9/2014 Lan ..... H01R 27/02 439/607.23

* cited by examiner

*Primary Examiner* — Jean F Duverne
(74) *Attorney, Agent, or Firm* — Hauptman Ham, LLP

(57) ABSTRACT

A cable connector includes: an insulator, including a receiving slots and a terminal holes, with an insertion space formed by the insulator and the terminal holes situated on one side of the insertion space; a circuit board, comprising a first conductive parts and a second conductive parts, with each first conductive part electrically connected to the second conductive part, and the first conductive parts and the second conductive parts situated on opposite sides of the circuit board; a terminals, embedded in a receiving slots of the insulator, with one end of each terminal is connected to the first conductive part of the circuit board; a wire transmission device, including a conductors, which connect the second conductive parts of the circuit board. The insulator has an insertion space, next to the terminal holes, and the terminals go through the terminal holes and extend into the insertion space.

17 Claims, 5 Drawing Sheets

CABLE CONNECTOR

CROSS REFERENCE TO RELATED APPLICATION

This application claims the priority of Taiwanese Patent Application No. 103204679, filed on Mar. 19, 2014, in the IPO (Intellectual Property Office, Ministry of Economic Affairs, Republic of China).

BACKGROUND OF THE INVENTION

1. Filed of the Invention

The present invention is related to an electrical connector, and especially to cable connector.

2. Description of the Prior Art

The conventional technology is an electrical connector that connects cables to a card edge interface. It has a housing portion comprising a first surface, and a second surface opposite the said first surface, and the surfaces are spaced apart to define a housing portion slot for the card edge interface. Furcated contact elements are disposed within the housing. Each contact element has a first tine portion with an exposed contact interface portion, a second tine portion, a web portion connecting the first and second tine portions, and a wire termination portion for terminating a conductor of the cable.

However, with the conventional technology, only the first tine portion serves as an electrical contact terminal to electrically connect a printed circuit board. The second tine portion only serves as a fixing terminal. Therefore, a conventional card edge cable connector only establishes a single row of electrical contact terminals above the connector. When more electrical contact terminals are needed, the width of the printed circuit board must increase, and the volume of the whole device will increase with the conventional card edge cable connector. Furthermore, if the width of the printed circuit board does not increase, both sides of the circuit board must be capable of electrical connection, and double-row electrical contact terminals must be installed above and below the conventional card edge cable connector. Therefore, the structure of the conventional card edge cable connector still needs to be improved.

SUMMARY OF THE INVENTION

An object of the present invention is to provide a cable connector that uses hooks of terminals to clip and hold the circuit board, so to reduce the thickness and volume of the cable connector.

According to the present invention, a cable connector comprises: an insulator, comprising a plurality of receiving slots and a plurality of terminal holes, with an insertion space formed by the insulator and the plurality of terminal holes situated on one side of the insertion space; a circuit board, comprising a plurality of first conductive parts and a plurality of second conductive parts, with each first conductive part electrically connected to the second conductive part, and the plurality of first conductive parts and the plurality of second conductive parts situated on opposite sides of the circuit board; a plurality of terminals, embedded in a plurality of receiving slots of the insulator, with each terminal comprising a contact end and a hook, which clips and holds the circuit board so that one end of the hook is connected to the first conductive part of the circuit board; a wire transmission device, comprising a plurality of conductors, which connect the plurality of second conductive parts of the circuit board. The insulator has an insertion space, next to the plurality of terminal holes, and the contact ends of the plurality of terminals go through the plurality of terminal holes and extend into the insertion space.

In one aspect of the present invention, the cable connector further comprises a cover body comprising a plurality of locking parts that lock and fasten to a plurality of fixing parts of the insulator.

In another aspect of the present invention, the cover body comprises a plurality of limiting parts comprising a corresponding locking part, are used to fix the circuit board between the cover body and the insulator when the plurality of locking parts of the cover body lock and fasten to the plurality of fixing parts of the insulator.

In another aspect of the present invention, the cover body comprises a notch, from which the wire transmission device goes through and extends outwardly.

In another aspect of the present invention, the circuit board comprises a third conductive part, which situates on the same side of the circuit board as the plurality of first conductive parts, which are electrically connected to the third conductive part.

In another aspect of the present invention, the front end of the wire transmission device comprises a bend, and the plurality of conductors extend in accordance with the bend's angle and contact the plurality of second conductive parts.

In another aspect of the present invention, the circuit board comprises a plurality of through holes that penetrate the circuit board, and by which the plurality of first conductive parts are electrically connected to the plurality of second conductive parts.

In still another aspect of the present invention, each hook is U-shaped.

In yet another aspect of the present invention, the wire transmission device is a flexible cable, a flexible printed circuit board or a metal cable.

According to the present invention, a cable connector comprises: an insulator, comprising a plurality of receiving slots and a plurality of terminal holes, with an insertion space formed by the insulator and the plurality of terminal holes situated on one side of the insertion space; a circuit board, comprising a plurality of first conductive parts and a plurality of second conductive parts, with each first conductive part electrically connected to the second conductive part; a plurality of terminals, embedded in a plurality of receiving slots of the insulator, with one end of each terminal is connected to the first conductive part of the circuit board; a wire transmission device, comprising a plurality of conductors, which connect the plurality of second conductive parts of the circuit board. The insulator has an insertion space, next to the plurality of terminal holes, and the plurality of terminals go through the plurality of terminal holes and extend into the insertion space.

In one aspect of the present invention, the cable connector further comprises a cover body comprising a plurality of locking parts that lock and fasten to a plurality of fixing parts of the insulator.

In another aspect of the present invention, the cover body comprises a plurality of limiting parts comprising a corresponding locking part, are used to fix the circuit board between the cover body and the insulator when the plurality of locking parts of the cover body lock and fasten to the plurality of fixing parts of the insulator.

In another aspect of the present invention, the cover body comprises a notch, from which the wire transmission device goes through and extends outwardly.

In another aspect of the present invention, the circuit board comprises a third conductive part, which situates on the same side of the circuit board as the plurality of first conductive parts, which are electrically connected to the third conductive part.

In another aspect of the present invention, the front end of the wire transmission device comprises a bend, and the plurality of conductors extend in accordance with the bend's angle and contact the plurality of second conductive parts.

In still another aspect of the present invention, the circuit board comprises a plurality of through holes that penetrate the circuit board, and by which the plurality of first conductive parts are electrically connected to the plurality of second conductive parts.

In yet another aspect of the present invention, the wire transmission device is a flexible cable, a flexible printed circuit board or a metal cable.

In contrast to prior art, the cable connector of the present invention uses hooks of terminals to clip and hold the circuit board, so that one end of the hook contacts a corresponding first conductive parts of the circuit board. In addition, conductors of a wire transmission device connect corresponding second conductive parts. The first conductive parts and second conductive parts are situate on opposite sides of the circuit board, and are connected electrically by through holes. Give that the cable connector only needs a single circuit, which is directly clipped and held by the terminals, a favorable result of the reduction of the thickness and volume of the cable connector is achieved.

These and other objectives of the claimed invention will no doubt become obvious to those of ordinary skill in the art after reading the following detailed description of the preferred embodiment that is illustrated in the various figures and drawings.

DETAILED DESCRIPTION OF THE PREFERRED EMBODIMENTS

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

Figure 1:
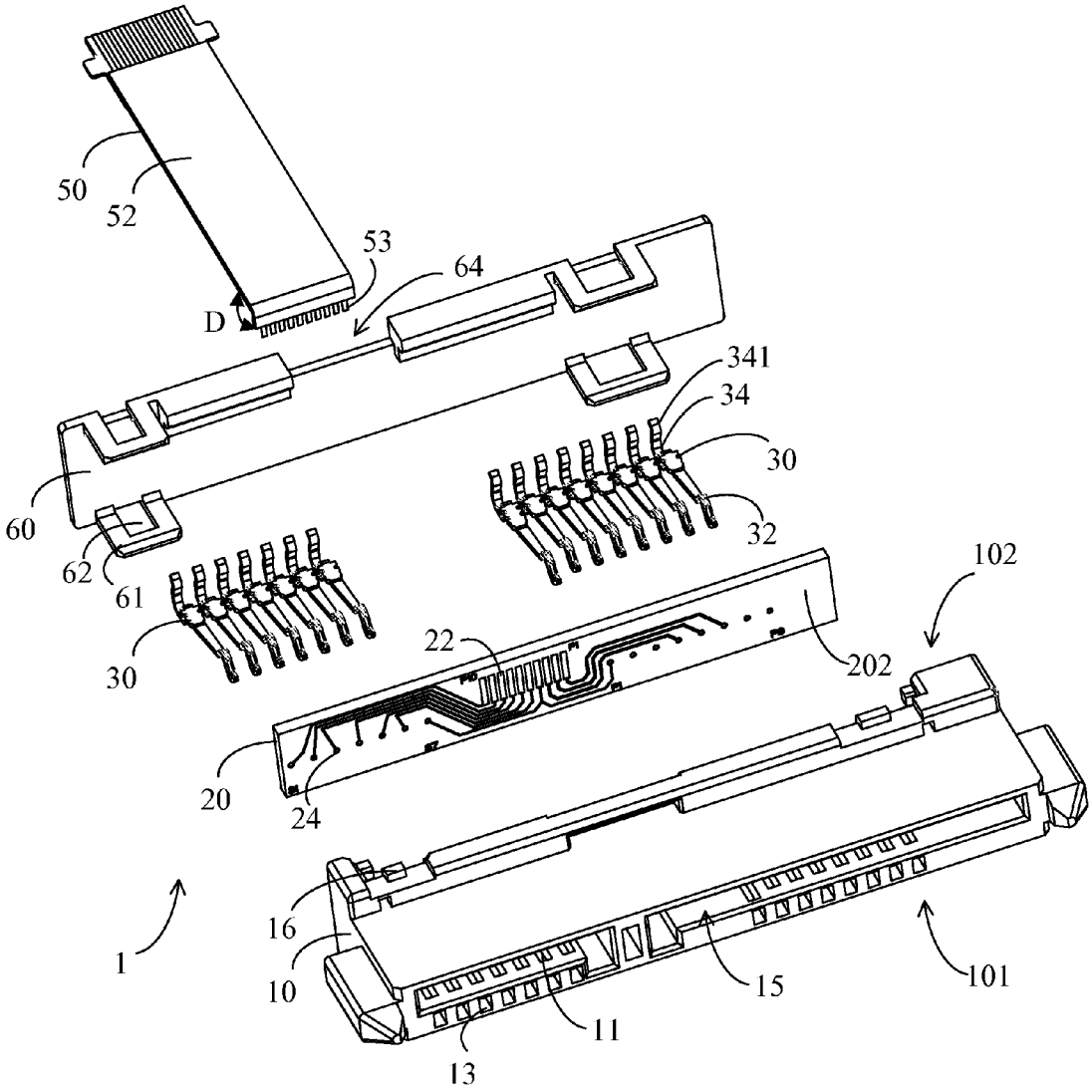
FIGS. 1 and 2 show exploded views of a cable connector according to a preferred embodiment of the present invention.
Figure 2:
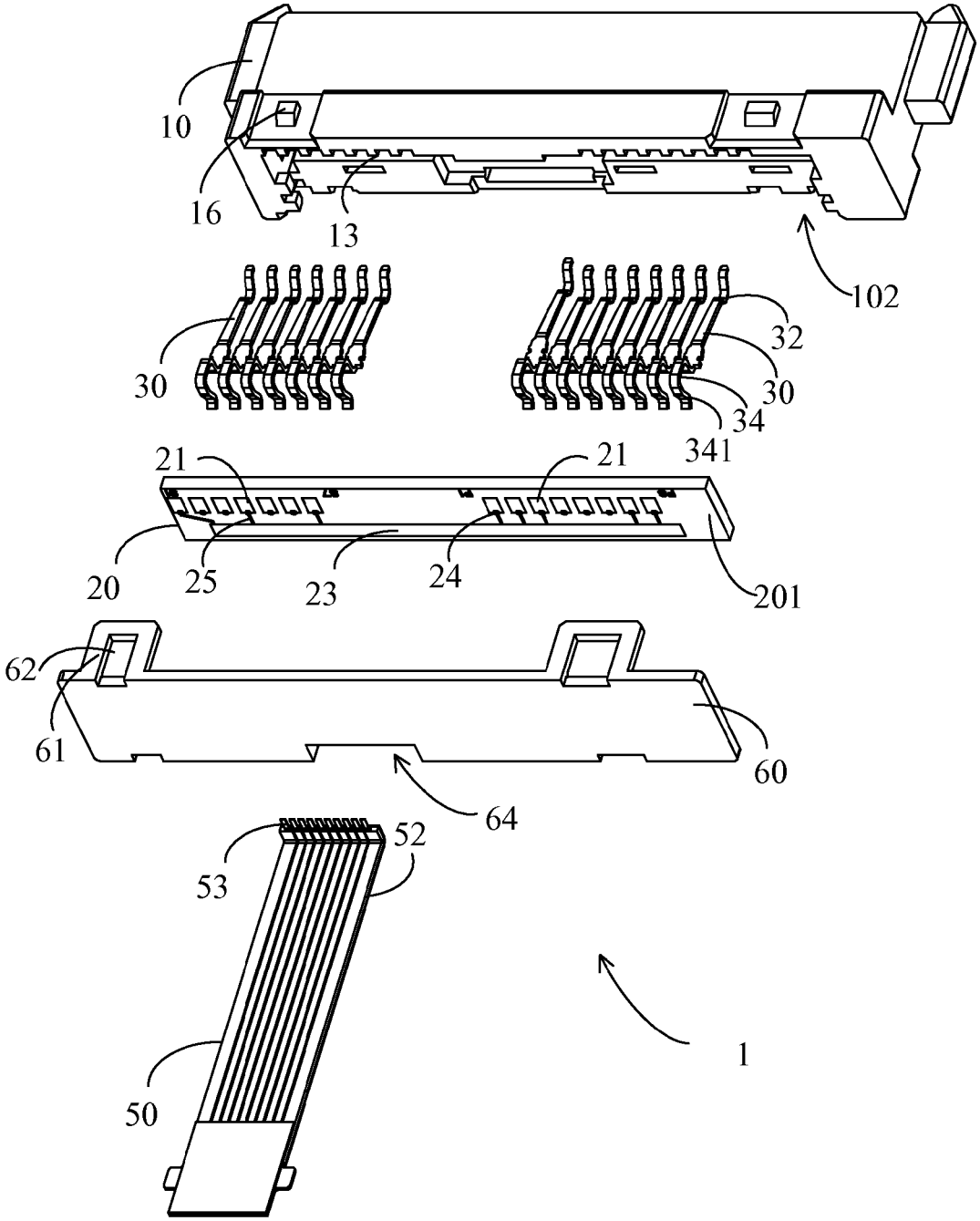

Please refer to FIGS. 1 and 2, showing exploded views of a cable connector 1 of the present invention. In a preferred embodiment, the cable connector 1 comprises an insulator 10, a circuit board 20, a plurality of terminals 30, a wire transmission device 50 and a cover body 60.

The insulator 10 comprises a plurality of terminal holes 11 and a plurality of receiving slots 13. The front end 101 of the insulator 10 forms an insertion space 15, where another plug can be inserted in.

The circuit board 20 comprises a plurality of first conductive parts 21, and a plurality of second conductive parts 22, a third conductive part 23 and a plurality of through holes 24. The plurality of first conductive parts 21 and the third conductive part 23 locate on a first side 201 of the circuit board 20. The plurality of second conductive parts 22 locate on a second side 202 of the circuit board 20. The first side 201 and the second side 202 are the two opposite surfaces of the circuit board 20. The plurality of through holes 24, coated with conductive materials (e.g. copper leaves), penetrate the circuit board 20, so that each first conductive part 21 is electrically connected to the second conductive part 22 via the through holes 24. The plurality of first conductive parts 21 and the third conductive part 23 are electrically connected via a trace 25. The third conductive part 23 is an internal wire of the circuit board 20 to provide specific voltages (e.g. a ground voltage or a 5V source) to some of the first conductive parts 21 and the second conductive parts 22. In another preferred embodiment, the third conductive part 23 can also be installed on the second side 202 along with the second conductive parts 22.

Figure 3:
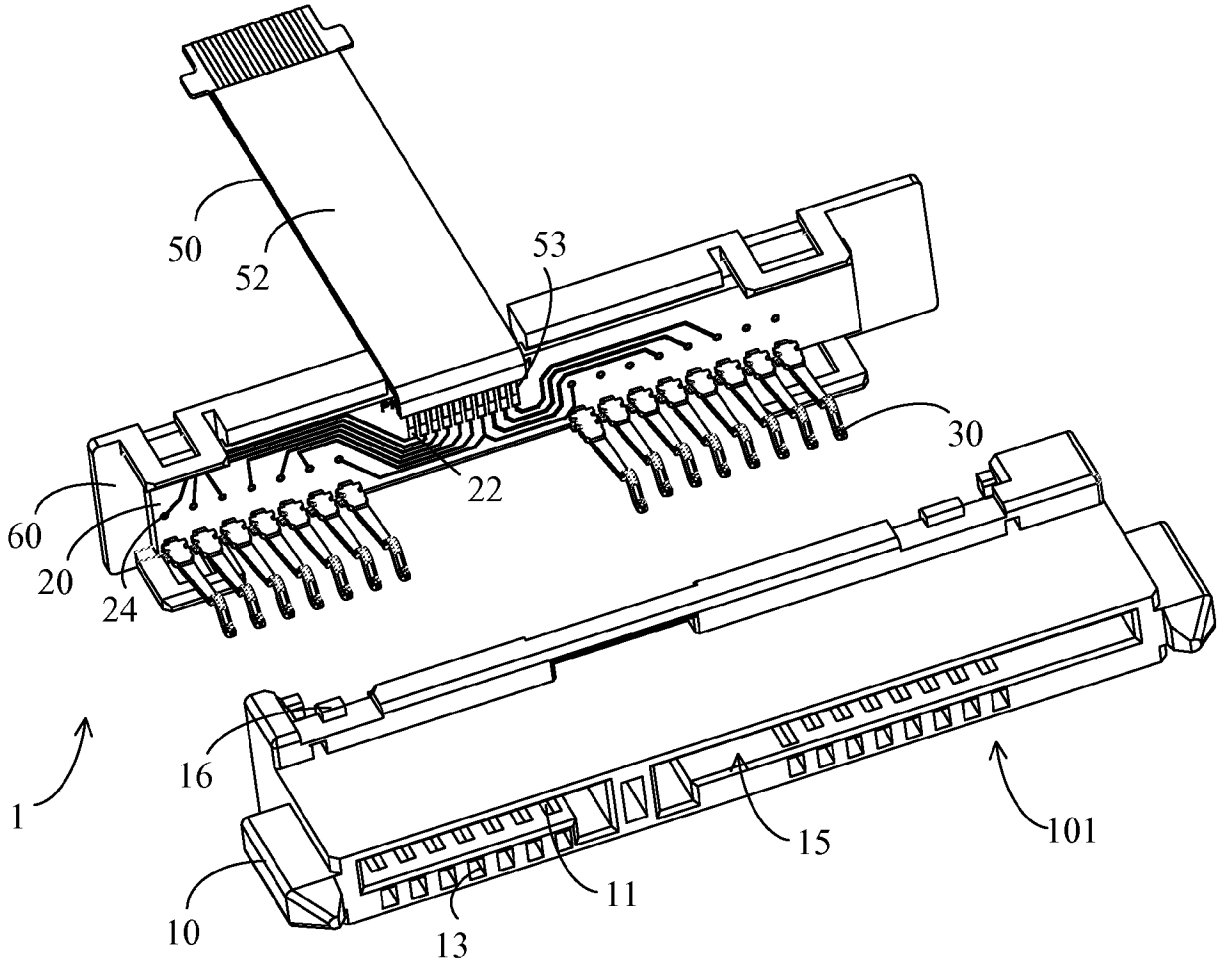
FIG. 3 shows an assembled circuit board, a plurality of terminals, a wire transmission device and a cover body.
Figure 4:
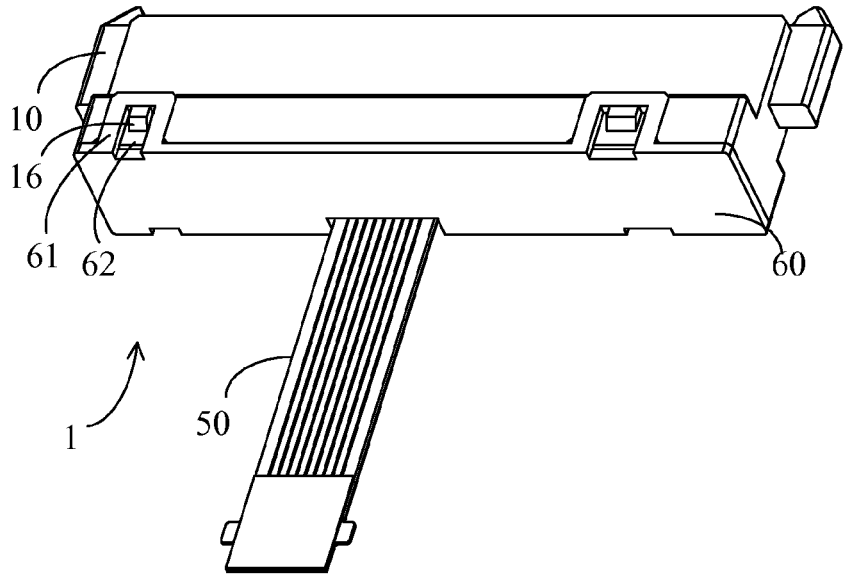
FIG. 4 shows a cable connector after the assembling is completed.
Figure 5:
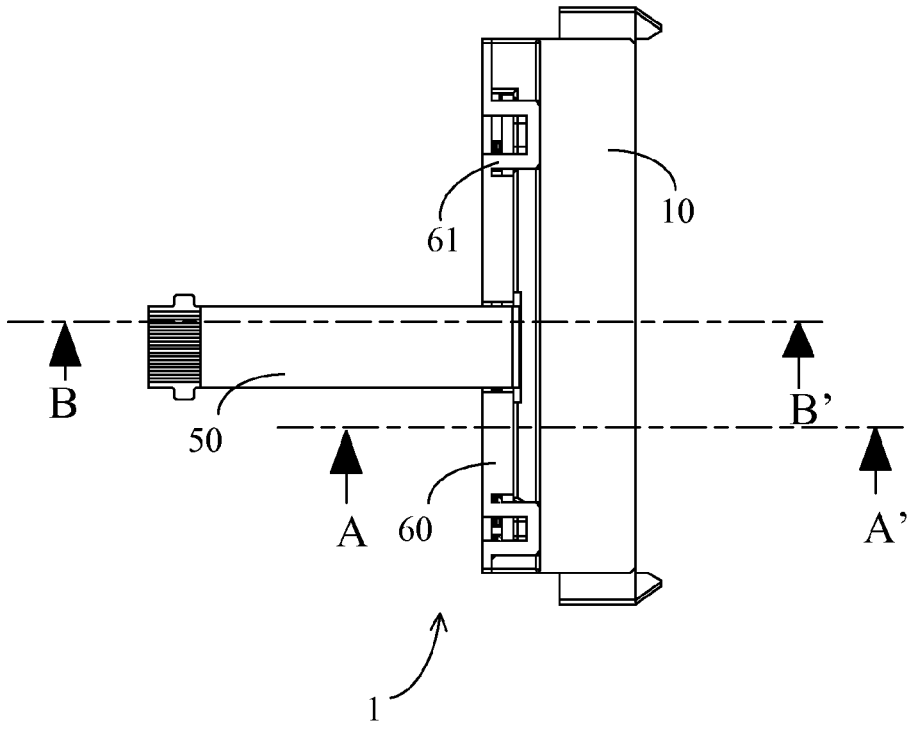
FIG. 5 shows a bottom view of the cable connector of FIG. 4.
Figure 6:
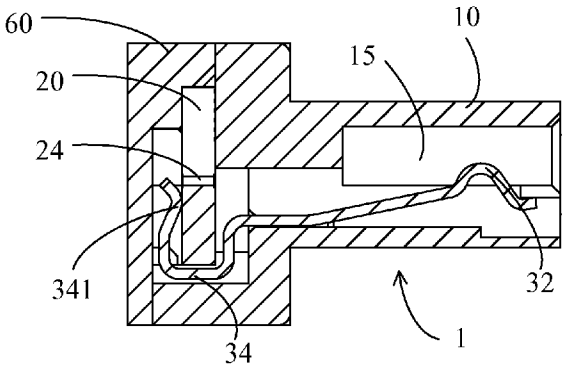
FIG. 6 shows a sectional view along a line from A to A' in FIG. 5.
Figure 7:
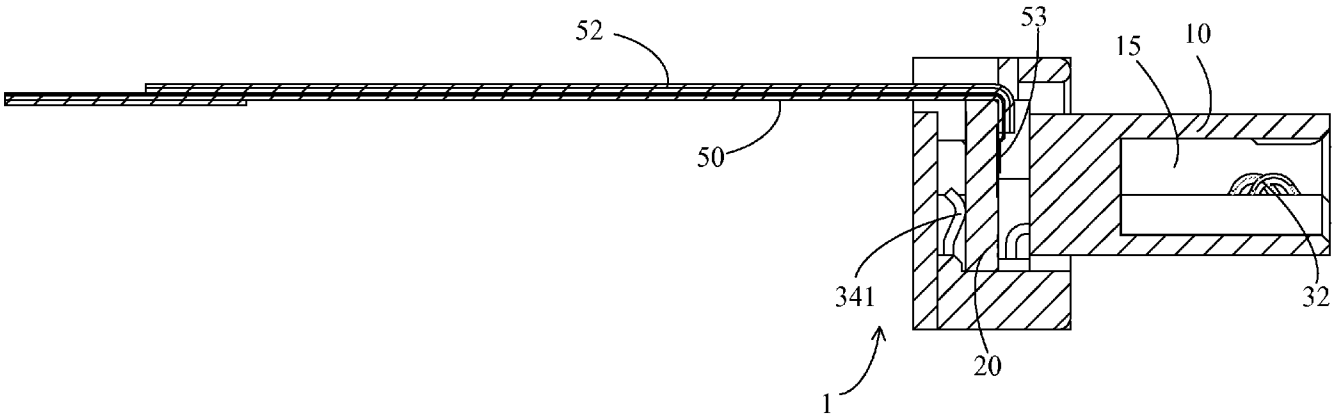
FIG. 7 shows a sectional view along a line from B to B' in FIG. 5.

Please refer to figures from FIG. 1 to FIG. 7. FIG. 3 shows an assembled circuit board 20, a plurality of terminals 30, a wire transmission device 50 and a cover body 60. FIG. 4 shows a cable connector 1 after the assembling is completed. FIG. 5 shows a bottom view of the cable connector 1 of FIG. 4. FIG. 6 shows a sectional view along a line from A to A' in FIG. 5. FIG. 7 shows a sectional view along a line from B to B' in FIG. 5. The terminals 30 are made of conductive materials (e.g. metal), and can be inserted from a back end 102 of the insulator 10 and embedded into the corresponding receiving slots 13 of the insulator 10. Each terminal 30 comprises a contact end 32 and a hook 34. The hooks 34, formed in U-shape, can clip and hold the circuit board 20 so that tails 341 of the hooks 34 are connected to the corresponding first conductive parts 21 of the circuit board 20. Preferably, the tails 341 of the hooks 34 are welded to the corresponding first conductive parts 21 of the circuit board 20. Each contact end 32 of the terminal 30 goes through the corresponding terminal hole 11 and extends into the insertion space 15. When a plug is inserted in the insertion space 15 of the cable connector 1, the plug can contact the protruding contact ends 32, so that the plug and the wire transmission device 50 can send electrical signals through the cable connector 1.

The wire transmission device 50 can be a flexible cable, flexible printed circuit board or metal cable. It has an insulating layer 52, which covers a plurality of conductors 53, which can be glued or welded to the plurality of second conductive parts 22 of the circuit board 20.

The front end of the wire transmission device 50 has a bend D, and the plurality of conductors 53 extend in line with the angle of the bend D and contact the plurality of second conductive parts 22. Preferably, the bend D forms a 90-degree angle, which allows the plurality of conductors 53 to easily connect to the plurality of second conductive parts 22 of the circuit board 20.

The cover body 60 comprises a plurality of limiting parts 61, located on the edges of both sides of the cover body 60. Each limiting part 61 is installed with a locking part 62. The locking part 62 locks on a fixing part 16 of the insulator 10, so that the cover body 60 is locked and fastened to the back end 102 of the insulator 10. In the present embodiment, the locking part 62 is an opening, and the fixing part 16 is a protuberance. In another embodiment, the locking part 62 is a protuberance and the fixing part 16 is an opening. The plurality of limiting parts 61 are used to fix the circuit board 20 between the cover body 60 and the insulator 10 when the plurality of locking parts 62 of the cover body 60 locks and fastens to a plurality of fixing parts 16 of the insulator 10. The cover body 60 also comprises a notch 64, from which the wire transmission device 50 goes through and extends outwardly.

The cable connector 1 makes use of the hook 34 of the terminal 30, so that the tail 341 of the hook 34 contacts the corresponding first conductive part 21 of the circuit board 20. In addition, the conductor 53 of the wire transmission device 50 connects the second conductive part 22 of the circuit board 20. The first conductive part 21 and the second conductive part 22 situates on opposite sides of the circuit board 20, and are electrically connected by the through hole 24. The cable connector 1 only needs one circuit board 20, by which the plurality of terminals 30 are electrically connected to the wire transmission device 50. The height of the insulator 10 can be minimized since the height of the circuit board 20 is less than or equal to that of the insulator 10. In addition, the terminals 30 can directly clip and hold the circuit board 20, so the favorable result of the reduction of the thickness and volume of the cable connector 1 is achieved.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A cable connector, comprising:

an insulator, comprising a plurality of receiving slots and a plurality of terminal holes, with an insertion space formed by the insulator and the plurality of terminal holes situated on one side of the insertion space;

a circuit board, comprising a plurality of first conductive parts and a plurality of second conductive parts, with each first conductive part electrically connected to the second conductive part, and the plurality of first conductive parts and the plurality of second conductive parts situated on opposite sides of the circuit board;

a plurality of terminals, embedded in a plurality of receiving slots of the insulator, with each terminal comprising a contact end and a hook, which clips and holds the circuit board so that one end of the hook is connected to the first conductive part of the circuit board;

a wire transmission device, comprising a plurality of conductors, which connect the plurality of second conductive parts of the circuit board;

wherein the insulator has an insertion space, next to the plurality of terminal holes, and the contact ends of the plurality of terminals go through the plurality of terminal holes and extend into the insertion space.

2. The cable connector of claim 1 further comprising a cover body comprising a plurality of locking parts that lock and fasten to a plurality of fixing parts of the insulator.

3. The cable connector of claim 2, wherein the cover body comprises a plurality of limiting parts comprising a corresponding locking part, are used to fix the circuit board between the cover body and the insulator when the plurality of locking parts of the cover body lock and fasten to the plurality of fixing parts of the insulator.

4. The cable connector of claim 2, wherein the cover body comprises a notch, from which the wire transmission device goes through and extends outwardly.

5. The cable connector of claim 1, wherein the circuit board comprises a third conductive part, which situates on the same side of the circuit board as the plurality of first conductive parts, which are electrically connected to the third conductive part.

6. The cable connector of claim 5, wherein the front end of the wire transmission device comprises a bend, and the plurality of conductors extend in accordance with the bend's angle and contact the plurality of second conductive parts.

7. The cable connector of claim 1, wherein the circuit board comprises a plurality of through holes that penetrate the circuit board, and by which the plurality of first conductive parts are electrically connected to the plurality of second conductive parts.

8. The cable connector of claim 1, wherein each hook is U-shaped.

9. The cable connector of claim 1, wherein the wire transmission device is a flexible cable, a flexible printed circuit board or a metal cable.

10. A cable connector, comprising:

an insulator, comprising a plurality of receiving slots and a plurality of terminal holes, with an insertion space formed by the insulator and the plurality of terminal holes situated on one side of the insertion space;

a circuit board, comprising a plurality of first conductive parts and a plurality of second conductive parts, with each first conductive part electrically connected to the second conductive part;

a plurality of terminals, embedded in a plurality of receiving slots of the insulator, with one end of each terminal connected to the first conductive part of the circuit board;

a wire transmission device, comprising a plurality of conductors, which connect the plurality of second conductive parts of the circuit board;

wherein the wire transmission device is a flexible cable, the insulator has an insertion space, next to the plurality of terminal holes, and the plurality of terminals go through the plurality of terminal holes and extend into the insertion space.

11. The cable connector of claim 10 further comprising a cover body comprising a plurality of locking parts that lock and fasten to a plurality of fixing parts of the insulator.

12. The cable connector of claim 11, wherein the cover body comprises a plurality of limiting parts comprising a corresponding locking part, are used to fix the circuit board between the cover body and the insulator when the plurality of locking parts of the cover body lock and fasten to the plurality of fixing parts of the insulator.

13. The cable connector of claim 11, wherein the cover body comprises a notch, from which the wire transmission device goes through and extends outwardly.

14. The cable connector of claim 10, wherein the circuit board comprises a third conductive part, which situates on the same side of the circuit board as the plurality of first conductive parts, which are electrically connected to the third conductive part.

15. The cable connector of claim 14, wherein the front end of the wire transmission device comprises a bend, and the plurality of conductors extend in accordance with the bend's angle and contact the plurality of second conductive parts.

16. The cable connector of claim 10, wherein the circuit board comprises a plurality of through holes that penetrate the circuit board, and by which the plurality of first conductive parts are electrically connected to the plurality of second conductive parts.

17. The cable connector of claim 10, wherein the wire transmission device is a flexible cable, a flexible printed circuit board or a metal cable.

* * * * *